United States Patent [19]

Kagerhuber et al.

[11] 4,290,478

[45] Sep. 22, 1981

[54] GUIDING STAND TO BE USED IN A CONTINUOUS CASTING PLANT

[75] Inventors: Franz Kagerhuber, Traun; Günter Holleis, Linz, both of Austria

[73] Assignee: Voest-Alpine Aktiengesellschaft, Linz, Austria

[21] Appl. No.: 46,344

[22] Filed: Jun. 7, 1979

[30] Foreign Application Priority Data

Jun. 14, 1978 [AT] Austria ..... 4330/78

[51] Int. Cl.[3] ..... B22D 11/12

[52] U.S. Cl. ..... 164/448; 164/442

[58] Field of Search ..... 164/442, 448; 193/35 R; 226/174

[56] References Cited

FOREIGN PATENT DOCUMENTS

| | | | |
|---|---|---|---|
| 1171119 | 12/1964 | Fed. Rep. of Germany . | |
| 1160280 | 3/1969 | Fed. Rep. of Germany . | |
| 1804666 | 6/1971 | Fed. Rep. of Germany . | |
| 46-31667 | 9/1971 | Japan | 164/448 |
| 965884 | 8/1964 | United Kingdom | 164/448 |
| 316527 | 2/1972 | U.S.S.R. | 164/448 |
| 264638 | 4/1977 | U.S.S.R. | 164/448 |

*Primary Examiner*—Robert D. Baldwin
*Assistant Examiner*—Gus T. Hampilos
*Attorney, Agent, or Firm*—Brumbaugh, Graves, Donohue & Raymond

[57] ABSTRACT

A guiding stand to be used in a continuous casting plant includes rollers supporting the strand at opposite sides and arranged in a supporting framework. The rollers, at least at one side of the strand, are mounted in guide rods pivotably arranged in the supporting framework for adjustment to various strand thicknesses. The guide rods are pivotable by an adjustment device, and the guide rods of neighboring rollers are each connected with one another by coupling rods in the manner of a four-bar linkage.

5 Claims, 11 Drawing Figures

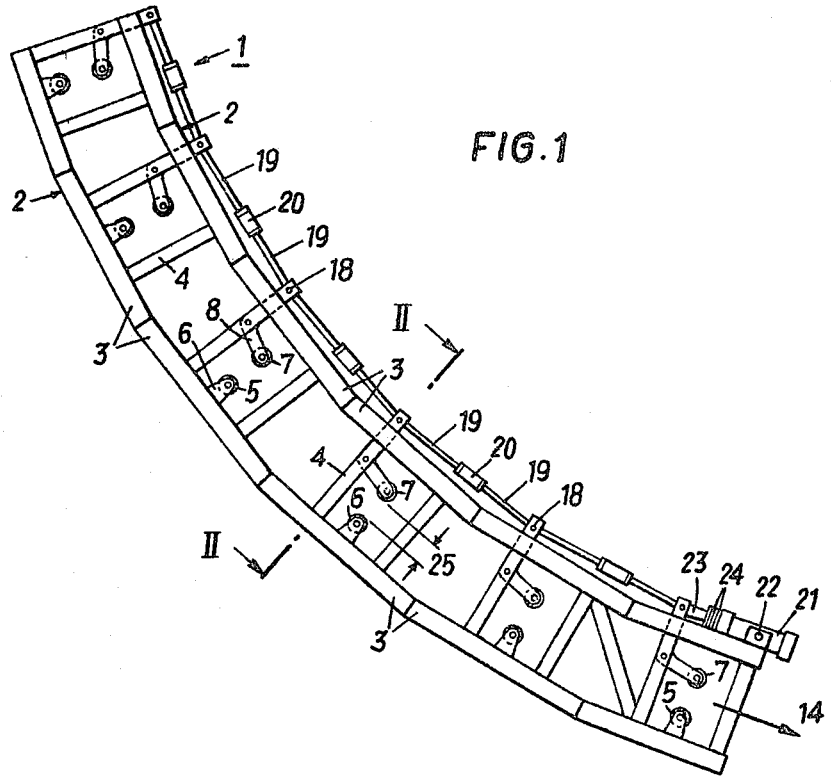
FIG. 1
FIG. 2
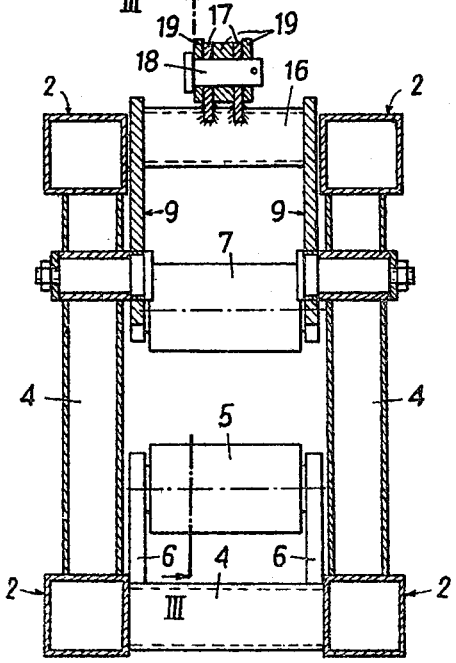
FIG. 3
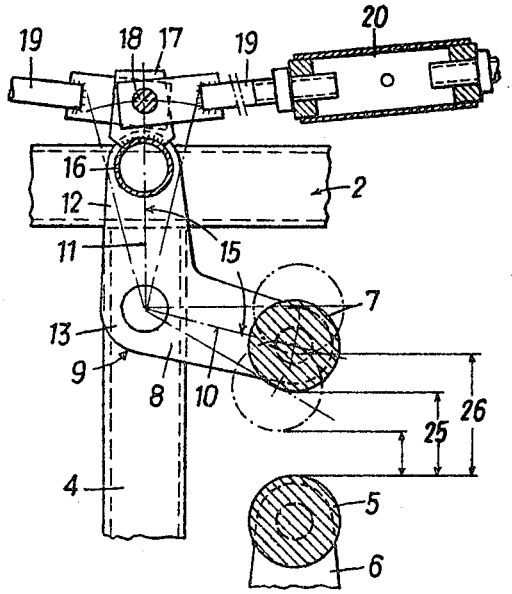

GUIDING STAND TO BE USED IN A CONTINUOUS CASTING PLANT

BACKGROUND OF THE INVENTION

The invention relates to a guiding stand for continuous casting plants, in particular for casting plants for billets or blooms, comprising rollers supporting the strand at opposite sides thereof and arranged in a supporting framework. At least the rollers at one side of the strand, for the purpose of adjustment to various strand thicknesses, are mounted in guide rods that are pivotably arranged at the supporting framework and are pivotable by means of an adjustment device.

A guiding stand of this kind is known from German Pat. No. 1,171,119. The rollers provided at one side of the strand, in this known stand, are mounted in a stationary part of the stand, whereas the rollers for supporting the other side of the strand are mounted in radially arranged guides of a stand part that can be displaced relative to the stationary stand part. The rollers of this displaceable stand part are connected, by guide rods engaging their bearing necks, with the bearing necks of the opposite rollers mounted in the stationary part of the stand. When changing the roller distance of oppositely arranged rollers by displacing the displaceable stand part, the bearing necks of the rollers of the displaceable stand part will slide in the radially arranged guides. Since such guiding stands for continuous casting plants have to be within the cooling chamber, those radial guides are subjected to intensive dirt accumulation from rust, cinders, etc., so that it is not possible to change the casting format without having checked and serviced the guides before hand. Furthermore, the displaceable guiding part has to be heavily dimensioned in order to be sufficiently rigid, which results in the additional disadvantage of having to dimension the displacement device for moving the strand part accordingly heavy.

SUMMARY OF THE INVENTION

The present invention aims at avoiding these disadvantages and difficulties and has as its object to provide a guiding stand of the initially-described kind which makes possible a displacement of the format of the strand thickness within a short span of time, the use of light construction and the displacement of the format without any special attendance.

These objects are achieved according to the invention in that the guide rods of neighbouring rollers are each connected with each other by coupling rods arranged in the manner of a four-bar linkage.

Advantageously, the guide rods are designed as angle levers whose two lever arms together enclose an approximately right or obtuse angle, the rollers each being hinged to the end of one lever arm and the coupling rods each being hinged to the end of the other lever arm. The angle levers are pivotably mounted at the framework in the region of the apex of their angles. According to a preferred embodiment, the lever arms to which the coupling rods are hinged, in their mid-position, are directed radially, i.e. in the direction towards the centre of an arcuate guiding stand, and are connected by the coupling rods so as to form four-bar linkage trapezoids.

A further advantageous embodiment is characterized in that the angle levers of neighbouring rollers of the possibly arcuate guiding stand are connected by the coupling rods in the manner of a four-bar linkage parallelogram.

For the purpose of balancing out deviations in the positions of the rollers from a circular arc when pivoting the angle levers, the roller-carrying lever arms of neighbouring rollers each advantageously have a length that decreases in steps from roller to roller, the longest lever arm being arranged at the roller at the beginning of the arcuate guiding stand, and the lever arms of the suceeding rollers being designed in a manner such that each is shortened by a certain measure.

For the same purpose it is also suitable to have hinge points of the levers at the arcuate guiding stand spaced from the centre of the arcuate guiding stand at distances that increase in steps from roller to roller, the longest distance being provided for the hinge point of the lever of the roller arranged at the end of the guiding stand, and the distances of the hinge points of the levers of the precedingly arranged rollers each being shortened by a certain measure.

Balancing out of the deviations in the positions of the rollers, according to a preferred embodiment, can also be effected if the lever arms of the angle levers of neighbouring rollers each enclose different angles.

In order to balance out bearing plays and finishing inaccuracies, the coupling rods are adjustable in length.

In order to arrange the displaceable rollers resiliently in the direction away from the strand surface for the protection of the guiding stand, the roller-carrying lever arms advantageously are directed towards the end of the guiding stand carrying the adjustment device, which device is designed as a hydraulic cylinder.

BRIEF DESCRIPTION OF THE DRAWINGS

The invention will now be explained in more detail by way of several embodiments and with reference to the accompanying drawings, wherein:

FIG. 1 is a schematically represented side view of the guiding stand;

FIG. 2 is a section along line II—II of FIG. 1, and FIG. 3 is a section along line III—III of FIG. 2, of one embodiment;

DESCRIPTION OF ILLUSTRATIVE EMBODIMENTS

Figures 4, 5, 6:
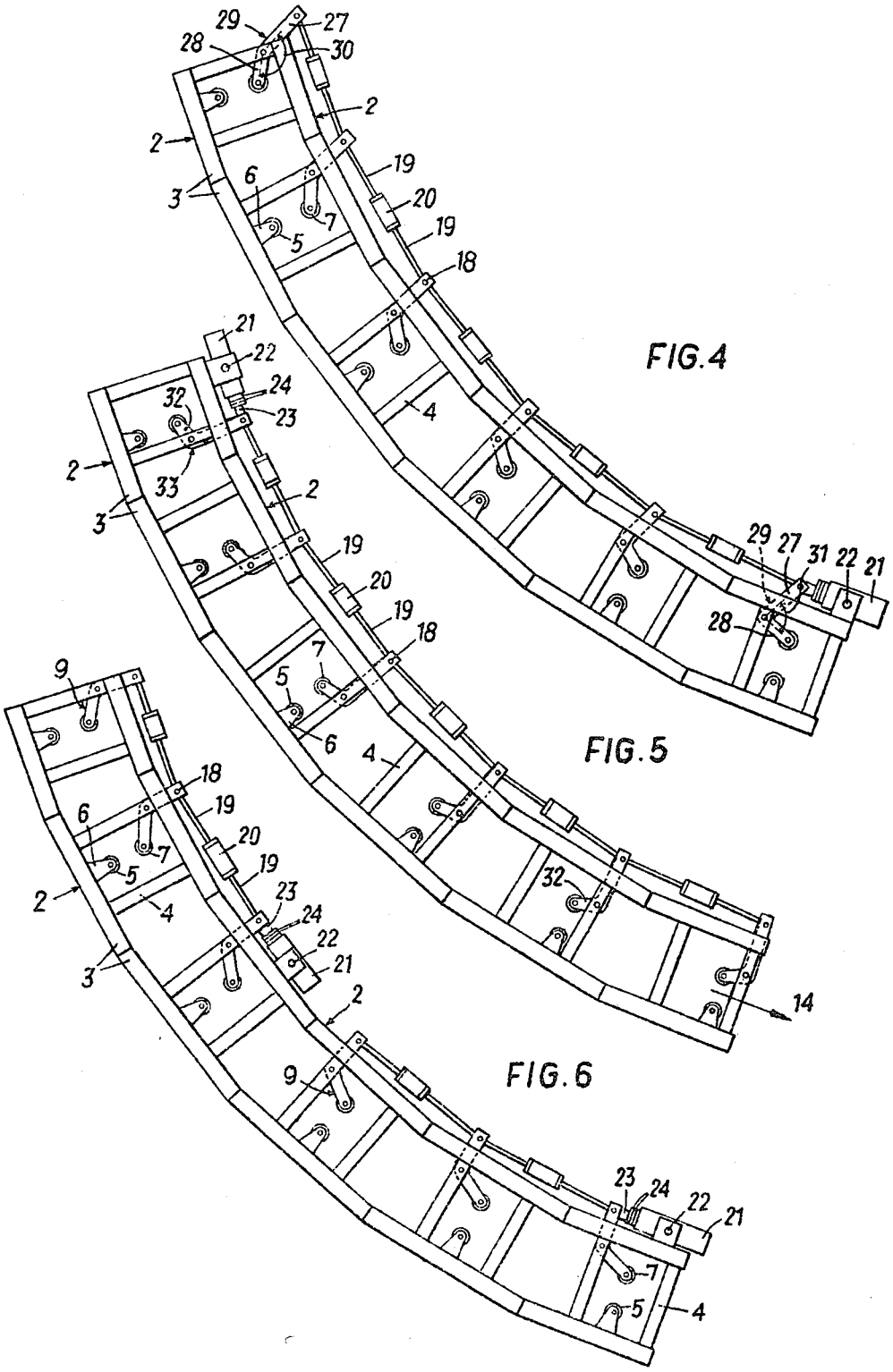
FIGS. 4, 5 and 6 represent three further embodiments in an illustration analogous to FIG. 1.

In FIG. 1, there is shown a cage-like circular-arc-shaped supporting framework 1 comprised of four longitudinal beams 2 assembled of sections 3, and transverse beams 4 arranged at right angles to the sections for maintaining the longitudinal beams at a distance from each other. The cross section at right angles to the longitudinal beams is rectangular, as can be seen from FIG. 2. The support of this supporting framework 1 on the base is not illustrated in detail. At the longitudinal beams 2 arranged at the arc outer side of the supporting framework 1, rollers 5 are mounted at regular distances for supporting the strand surface, which rollers are rotatably mounted in bearing supports 6. The rollers 7 for supporting the strand surface at the arc inner side are each rotatably mounted at the end of an arm 8 of a guiding rod designed as an angle lever 9. Each angle lever 9 is pivotably fastened at a transverse beam 4, at the intersecting point of the longitudinal axes 10, 11 of its arms 8 and 12, i.e. in the region of its angle apex 13. Each arm 8 carrying a roller 7 is directed toward the extraction direction of the strand, which in FIG. 1 is denoted by an arrow 14, and the other arm 12, which encloses an obtuse angle 15 with the roller-carrying arm 8, is directed radially inwardly when in its mid-position, i.e. in direction towards the centre of the circular-arc-shaped supporting framework 1.

for mounting the arc inner-side rollers 7, two of the angle levers 9 are provided for each roller, which levers, as can be seen from FIG. 2, are each arranged at the respective ends of the rollers. The ends of the two radially directed arms 12 of the angle levers 9, which are allocated to one of the rollers 7, are each welded together by a transverse pipe 16 having lugs 17 placed in its middle thereof. These lugs are penetrated by a bolt 18 directed parallel to the rollers. To the bolts 18, coupling rods 19 are hinged, which rods connect the bolts 18 of two neighbouring rollers 7, i.e. rollers arranged one behind the other. As a result, the radially directed arms 12 of the angle levers 9 of neighbouring rollers 7 are connected in the manner of a linkage trapezoid i.e., a four-bar linkage consisting of the frame 3, 4, the coupling rod 19 and the angle levers 9, which form a trapezoidal shape in the mid-position of the pivotal movement of the linkage. For balancing out finishing inaccuracies and bearing plays at the joints, the coupling rods 19 can be changed with regard to their lengths by means of a turnbuckles 20.

At the lower run-out end of the supporting framework 1, a hydraulic cylinder 21 is mounted so as to be pivotable about an axis 22. The piston rod 23 of the cylinder is articulately fastened to the transverse pipe 16 allocated to the last run-out-end-roller 7. By means of the hydraulic cylinder all of the rollers 7 arranged at the arc inner side can be pivoted simultaneously into different distances relative to the respective opposite rollers 5, as is illustrated in FIG. 3 by dot-and-dash lines. The hydraulic cylinder 21 remains under pressure during operation in such a manner that it will pull the radially directed arms 12 of the angle levers 9 in the extraction direction 14 of the strand. This movement is delimited by shims 24 on the piston rod 23. These shims 24 thus determine the distance 25 between opposite rollers. If the rollers 7 are strained too much by the strand, for instance when extracting a cooled strand end, the piston rod 23 of the hydraulic cylinder 21 can be moved contrary to the extraction direction 14, thus preventing damage to the supporting framework, as well as the rollers. As soon as the strain on the rollers 7 has again decreased to the normal extent, the piston rod is pulled back into the original position until it contacts the shims 24.

When setting up the guiding stand, for the first adjustment of a certain roller distance, the following procedure is used:

At first, a spacer of a certain thickness is provided between the pair of opposing rollers 5 and 7 next to the hydraulic cylinder 21, and the arc-inner-side roller 7 is pressed against the spacer by the admission of a hydraulic pressure medium to the hydraulic cylinder 21. Between the rollers 5, 7 of the neighbouring roller pair, an equally thick spacer is then provided, and the arc-inner-side roller 7 is also brought into contact with the spacer by adjustment of the turnbuckle 20. The adjustment of the distance between the rollers of the other roller pairs is effected in the same way.

For changing the casting cross secton, i.e. the distance 25 of oppositely arranged rollers, first the piston rod 23 of the hydraulic cylinder is totally moved out, so that a maximal distance 26 will be adjusted between two oppositely arranged rollers, then a shim having a certain thickness is put onto the part of the piston rod 23 projecting out of the hydraulic cylinder 21, and the piston rod is pulled back into the cylinder until it is stopped at this shim. The thickness of the shim is chosen in accordance with the desired roller distance of the rollers arranged opposite each other.

The embodiment illustrated in FIG. 1 shows an arcuate guiding stand for a casting plant for billets. However, it may be applied also to casting plants for blooms or slabs as well as to straight guiding stands. The design of the guide rod as an angle lever merely is a preferred embodiment; it would also be possible to design the guide rod as a straight lever.

The embodiment illustrated in FIG. 4 of the guiding stand, in its principal construction features, is designed like the guiding stand shown in FIG. 1. The only difference is the formation of the four-bar linkages, which according to FIG. 4 are designed as linkage parallelograms and not as linkage trapezoids as in FIG. 1, i.e. arms 27, which correspond to arms 12 in FIG. 1, are parallel to each other in FIG. 4. In order to accomplish this arms 27, 28 of all of the angle levers denoted by 29 in FIG. 4, enclose different angles. The greatest angle 30 is provided at the beginning of the guiding stand, and the smallest angle 31 is provided at the run-out end of the guiding stand, with the angles decreasing in steps from roller to roller.

With the guiding stand illustrated in FIG. 5, the arms 32 of the angle levers 33 which carry the rollers, are directed opposite to the extraction direction 14, and the hydraulic cylinder 21 for displacing the angle levers 33 is arranged at the run-in end of the guiding stand.

A further embodiment of the guiding stand, which is constructed substantially like the guiding stand of FIG. 1, is shown in FIG. 6. With this embodiment, two hydraulic cylinders 21 are provided, each actuating a group of three angle levers 9.

Figures 7, 8, 9:
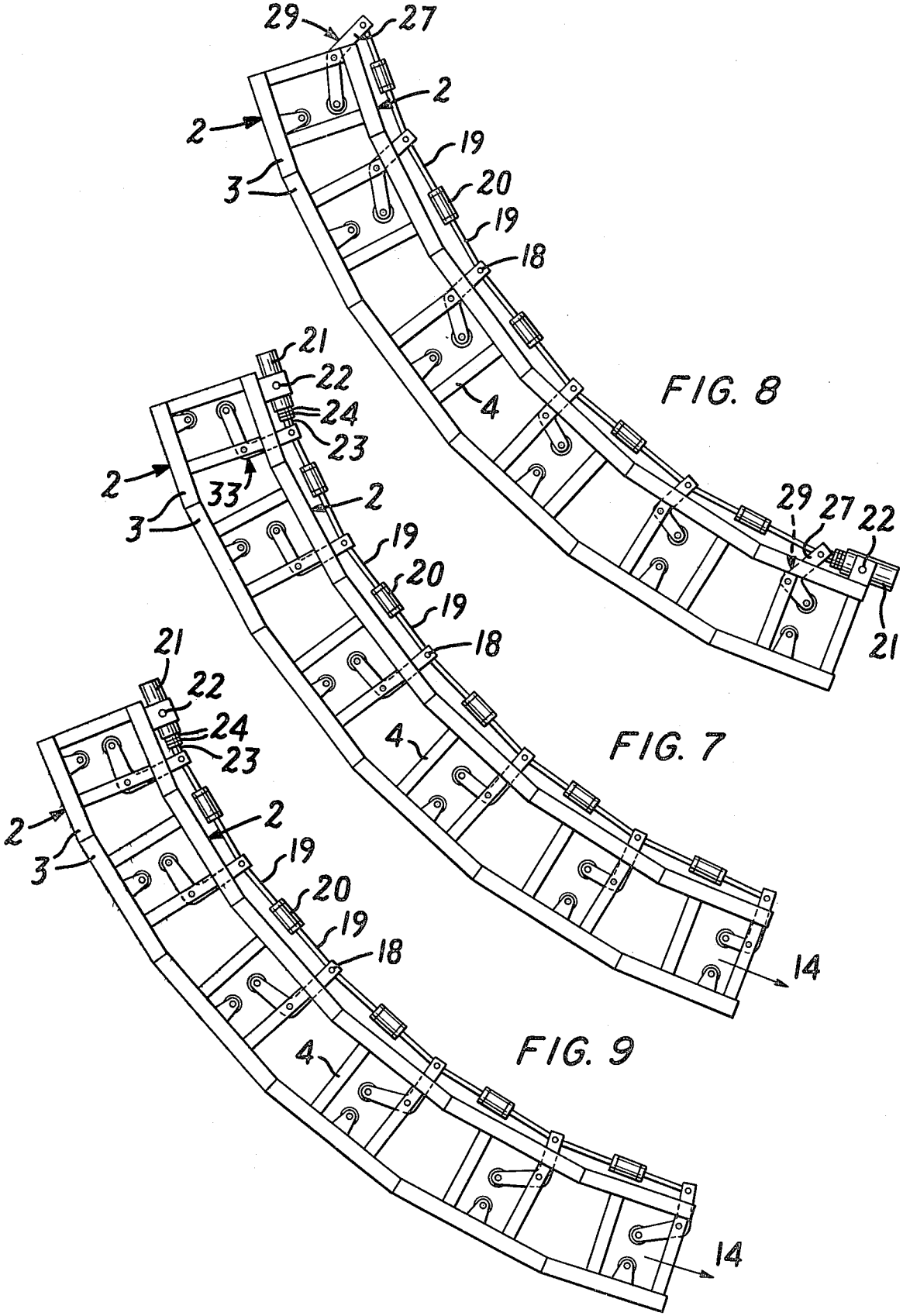
FIGS. 7, 8, 9, 10 and 11 represent five additional embodiments in illustrations analogous to FIG. 4.
Figure 10:
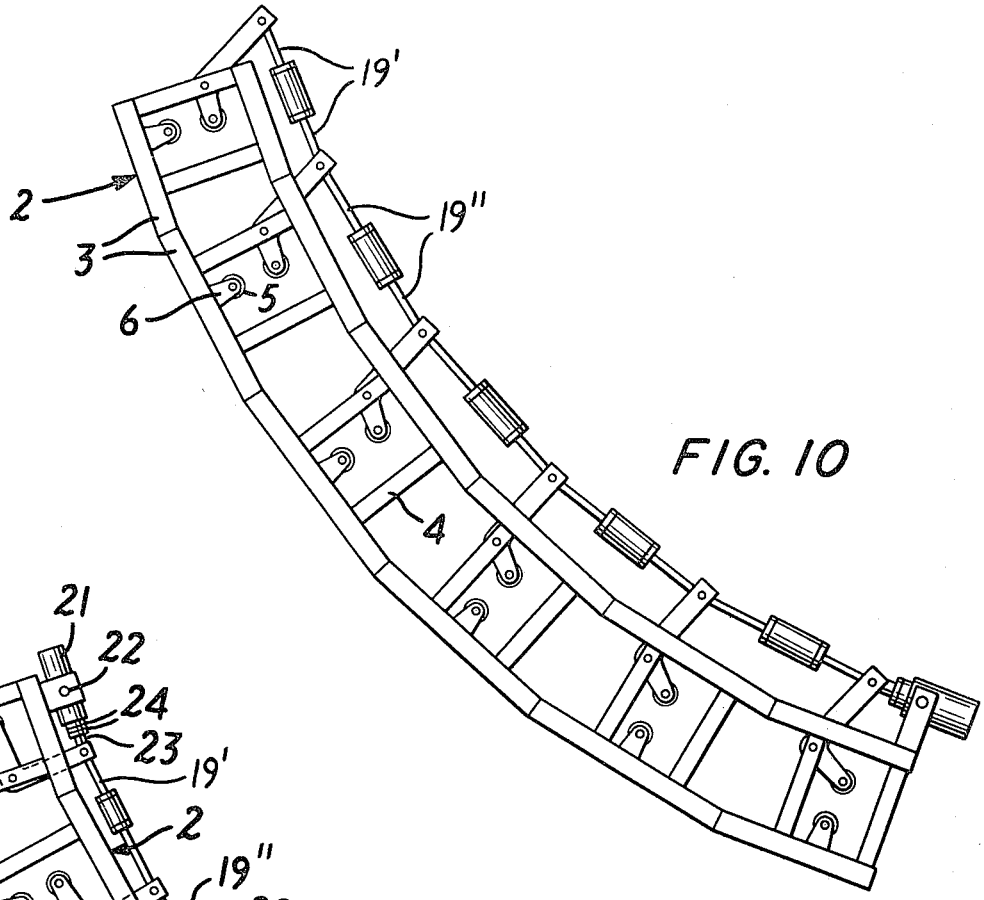

In order to balance out deviations in the positions of the rollers 7 from a circular arc when pivoting the angle levers, which go back to the geometry of an arcuate guiding stand, various possibilities may be chosen. As shown in FIGS. 7 and 8 the arms of the angle levers carrying the rollers 7 or those connected by the coupling rods, respectively, may have a length that decreases in steps from roller to roller. With such an arrangement the longest arm is arranged at the roller at the beginning of the arcuate guiding stand, i.e. at the run-in end, and the arms of the succeeding rollers are designed in such a manner that each is shortened by a certain measure depending on the radius of the guiding stand as well as the desired accuracy and the maximum range of displacement. It is, however, also possible to arrange the hinge points of the angle levers at the arcuate guiding stand so as to increase in their distances from the centre of the stand in steps from roller to roller as shown in FIG. 9. The greatest distance is provided for the hinge point of the lever of the roller arranged at the end of the guiding stand, and the distance of the lever of the preceding guiding rollers is shortened by a certain measure. This measure again depends on the radius of the guiding stand, on the maximum displacement range as well as on the desired accuracy in the positions of the rollers 7. A further possibility of balancing out deviations from the ideal roller positions at a circular arc for different roller distances is provided by changing the lengths of the coupling rods as shown in FIG. 10, wherein rod 19' is shorter then rod 19''.

Figure 11:
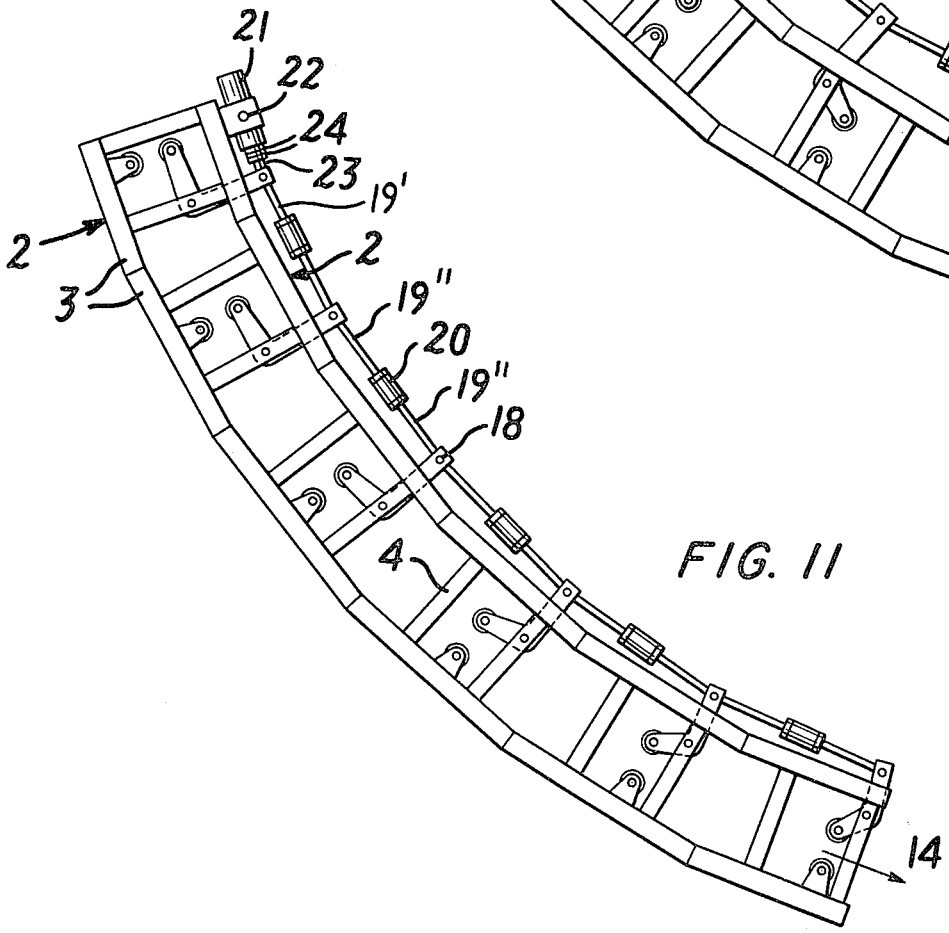

It is also possible to take several of the measures mentioned above simultaneously, e.g. a change in rod spacing coupled with a change in arm length as shown in FIG. 11.

The deviation in the position of the rollers 7 from a circular arc can, however, also be maintained on purpose, in order to precisely guide the strand, which tapers over its length due to thickness shrinking.

What we claim is:

1. In a guiding stand to be used in a continuous casting plant for casting a strand, for example a casting plant for casting a billet or bloom, and of the type including a supporting framework, rollers arranged at said supporting framework so as to support the strand at opposing sides thereof, guide rods pivotably arranged at said supporting framework to carry at their ends the rollers of at least one of said opposing sides of the strand and adjustment means for pivoting said guide rods so as to allow for an adjustment of the rollers to various strand thicknesses, the improvement comprising:

coupling rods connecting the guide rods of neighbouring rollers in the manner of a four-bar linkage such that the guide rods of neighbouring rollers are pivotally connected both to the framework and to the coupling rods;

angle levers as said guide rods, each lever comprising a first lever arm and a second lever arm which together enclose a certain angle, a roller being hinged to an end of said first lever arm and a coupling rod being hinged to an end of said second lever arm, said angle levers being pivotably mounted at said supporting framework near their angle apex; and an arcuate guiding stand having a center of curvature and a beginning where the strand enters it as said guiding stand, said second lever arms to which said coupling rods are hinged, in their mid-position, being directed in a radial manner in a direction toward the center of said arcuate guiding stand and being connected by said coupling rods in the manner of four-bar linkage trapezoids, said first lever arms of neighbouring rollers having stepwise decreasing lengths, the longest first lever arm being the first lever arm that carries the roller arranged at the beginning of said arcuate guiding stand, the first lever arms carrying the rollers following upon the roller arranged at the beginning of said arcuate guiding stand each being shortened by a certain measure relative to the preceding first lever arm.

2. In a guiding stand to be used in a continuous casting plant for casting a strand, for example a casting plant for casting a billet or bloom, and of the type including a supporting framework, rollers arranged at said supporting framework so as to support the strand at opposing sides thereof, guide rods pivotably arranged at said supporting framework to carry at their ends the rollers of at least one of said opposing sides of the strand and adjustment means for pivoting said guide rods so as to allow for an adjustment of the rollers to various strand thicknesses, the improvement comprising:

coupling rods connecting the guide rods of neighbouring rollers in the manner of a four-bar linkage such that the guide rods of neighbouring rollers are pivotally connected both to the framework and to the coupling rods;

angle levers as said guide rods, each lever comprising a first lever arm and a second lever arm which together enclose a certain angle, a roller being hinged to an end of said first lever arm and a coupling rod being hinged to an end of said second lever arm, said angle levers being pivotably mounted at said supporting framework near their angle apex; and an arcuate guiding stand with a beginning where the strand enters it as said guiding stand, said second lever arms of the angle levers of neighboring rollers being connected by said coupling rods in the manner of a four-bar linkage parallelogram, said first lever arms of neighbouring rollers having stepwise decreasing lengths, the longest first lever arm being the first lever arm that carries the roller arranged at the beginning of said arcuate guiding stand, the first lever arms carrying the rollers following upon the roller arranged at the beginning of said arcuate guide stand each being shortened by a certain measure relative to the preceding first lever arm.

3. A guiding stand as set forth in claims 1 or 2 wherein said angle levers are hinged to said arcuate guiding stand at points whose distances from the centre of said arcuate guiding stand increase stepwise from roller to roller, the greatest distance being provided between the point where the angle lever carrying the roller arranged at the end of the guiding stand is hinged to said guiding stand and the centre of said arcuate guiding stand, the respective distances for the angle levers carrying preceding rollers each being shortened by a certain measure.

4. In a guiding stand to be used in a continuous casting plant for casting a strand, for example a casting plant for casting a billet or bloom, and of the type including a supporting framework, rollers arranged at said supporting framework so as to support the strand at opposing sides thereof, guide rods pivotably arranged at said supporting framework to carry at their ends the rollers of at least one of said opposing sides of the strand and adjustment means for pivoting said guide rods so as to allow for an adjustment of the rollers to various strand thicknesses, the improvement comprising:

coupling rods connecting the guide rods of neighbouring rollers in the manner of a four-bar linkage such that the guide rods of neighbouring rollers are pivotally connected both to the framework and to the coupling rods;

angle levers as said guide rods, each lever comprising a first lever arm and a second lever arm which together enclose a certain angle, a roller being hinged to an end of said first lever arm and a coupling rod being hinged to an end of said second lever arm, said angle levers being pivotably mounted at said supporting framework near their angle apex; and an arcuate guiding stand having a center of curvature and an end where the strand leaves it as said guiding stand, said second lever arms to which said coupling rods are hinged, in their mid-position, being directed in a radial manner in a direction toward the center of said arcuate guiding stand and being connected by said coupling rods in the manner of four-bar linkage trapezoids, said angle levers being hinged to said arcuate guiding stand at points whose distances from the center of said arcuate guiding stand increase stepwise from roller to roller, the greatest distance being provided between the center of said arcuate guiding stand and the point where the angle lever carrying the roller arranged at the end of the guiding stand is hinged to said guiding stand, the respective distances for the angle levers carrying preceding rollers each being shortened by a certain amount.

5. A guiding stand to be used in a continuous casting plant for casting a strand, for example a casting plant for casting a billet or bloom, and of the type including a supporting framework, rollers arranged at said supporting framework so as to support the strand at opposing sides thereof, guide rods pivotably arranged at said supporting framework to carry at their ends the rollers of at least one of said opposing sides of the strand and adjustment means for pivoting said guide rods so as to allow for an adjustment of the rollers to various strand thicknesses, the improvement comprising:

coupling rods connecting the guide rods of neighbouring rollers in the manner of a four-bar linkage such that the guide rods of neighbouring rollers are pivotally connected both to the framework and to the coupling rods;

angle levers as said guide rods, each lever comprising a first lever arm and a second lever arm which together enclose a certain angle, a roller being hinged to an end of said first lever arm and a coupling rod being hinged to an end of said second lever arm, said angle levers being pivotably mounted at said supporting framework near their angle apex; and an arcuate guiding stand having a center of curvature and an end at which the stand leaves it as said guiding stand, said second lever arms of the angle levers of neighbouring rollers being connected by said coupling rods in the manner of a four-bar linkage parallelogram, said angle levers being hinged to said arcuate guiding stand at points whose distances from the center of said arcuate guiding stand increase stepwise from roller to roller, the greatest distance being provided between the center of said arcuate guiding stand and the point where the angle lever carrying the roller arranged at the end of the guiding stand is hinged to said guiding stand, the respective distances for the angle levers carrying preceding rollers each being shortened by a certain measure.

* * * * *